US007318240B1

(12) United States Patent
Rendone

(10) Patent No.: US 7,318,240 B1
(45) Date of Patent: Jan. 15, 2008

(54) ONE PIECE UNDERGARMENT BODYSUIT

(76) Inventor: Nicole Rendone, 445 W. 23rd St., Apt. 2A, New York, NY (US) 10011

( * ) Notice: Subject to any disclaimer, the term of this patent is extended or adjusted under 35 U.S.C. 154(b) by 50 days.

(21) Appl. No.: 11/388,872

(22) Filed: Mar. 24, 2006

(51) Int. Cl.
*A41B 9/08* (2006.01)
*A41C 9/00* (2006.01)
*A41C 1/00* (2006.01)

(52) U.S. Cl. ..... 2/69; 2/73; 2/78.1; 450/12

(58) Field of Classification Search ..... 2/400–408, 2/69, 227, 228, 79, 238, 67, 73, 78.1–78.4; 450/1, 5, 8–13, 64–69, 78, 92, 120
See application file for complete search history.

(56) References Cited

U.S. PATENT DOCUMENTS 3,847,158 A * 11/1974 Guidoni ..... 450/68
3,939,845 A * 2/1976 Guidoni ..... 450/68
4,031,900 A * 6/1977 Guidoni ..... 450/69
4,280,228 A 7/1981 Sulzmann
4,911,677 A 3/1990 White
4,917,651 A 4/1990 Rainville
5,032,104 A 7/1991 Rainville
5,239,706 A * 8/1993 Stevenson ..... 2/408
5,299,323 A * 4/1994 Schaefer et al. ..... 2/93
D353,559 S 12/1994 Fildan
5,499,404 A 3/1996 Marchiorello
5,590,443 A 1/1997 Fildan
5,624,296 A 4/1997 Weber-Unger
5,697,830 A 12/1997 White
5,862,527 A * 1/1999 Trevino ..... 2/406
5,864,890 A 2/1999 Niedermeyer
D410,411 S 6/1999 Fildan ..... D11/210
D412,462 S 8/1999 Fildan ..... D11/208
D413,549 S 9/1999 Fildan ..... D11/220
6,056,626 A 5/2000 Fildan
6,240,563 B1 6/2001 Niedermeyer
6,253,424 B1 7/2001 Rainville-Lonn
6,282,719 B1 9/2001 Vera
6,302,761 B1 10/2001 Wrenn
6,499,201 B2 12/2002 Fildan
6,513,209 B1 2/2003 Portzline
D473,363 S 4/2003 Loussier ..... D2/848
6,557,183 B1 5/2003 Truong
6,839,908 B2 1/2005 Schneider
6,854,132 B1 2/2005 Polzin
2002/0062541 A1 5/2002 Fildan
2002/0095752 A1 7/2002 Fildan
2002/0155786 A1 10/2002 Querquant
2003/0051287 A1 3/2003 Hatton
2004/0006878 A1 1/2004 Grove
2004/0226147 A1 11/2004 Fildan

* cited by examiner

*Primary Examiner*—Gloria M. Hale
(74) *Attorney, Agent, or Firm*—Law Offices of J. D. Geraigery, P.C.; Janine Geraigery

(57) ABSTRACT

A one piece undergarment for wear on a torso and legs of a body, having at least two elastic straps extending substantially parallel to one another. A plurality of moveable panels extending along the two straps and configured as a plurality of tube portions one above another, each panel having two parallel edges extending horizontally around the body. The moveable panel is secured by at least two moveable seams, each seam creating a channel by encasing the strap from one parallel edge to the other parallel edge of the moveable panel to slide upwardly and downwardly along the body.

3 Claims, 1 Drawing Sheet

ONE PIECE UNDERGARMENT BODYSUIT

BACKGROUND OF THE INVENTION

The invention relates to a one piece undergarment, and more particularly, to a one piece undergarment incorporated within apparel, preferably lingerie, which facilitates access to body parts, wide ranging adjustability, and greater level of comfort and support while being fashionable and sexy.

The manufacture of lingerie has changed over the centuries from early corsets during the renaissance to newly-created stockings by the end of the $19^{th}$ century to the underwire bra and light but strong fabrics of modern times. In many ways, fashion evolved but the goal remained the same, namely to fit the body and accentuate shape. The popularity of corsets, designed to constrain the silhouette, waned as women demanded more versatile apparel better suited to their changing roles at home and in society. The result was the emergence of more adjustable, accommodating lingerie that can be simple reconfigured rather than removed as evidenced by maternity clothing, strapless bras, crotchless and low rise panties. Today, woman are surrounded with an enormous array of lingerie styles, colors, and textures. These inventions are functional yet allow women to look feminine and sexy.

It is commonly known in the art that several pieces of lingeries employ features and strap assemblies, preferably to allow for adjustability of shoulder straps in a brassiere or other undergarment. Furthermore, other types of lingerie include clasped flaps or fully detachable pieces specifically designed to help those individuals who may be pregnant, nursing or handicapped. In both cases, these assemblies can make lingerie uncomfortable and less alluring as the assemblies bulge through outer clothing. Today's manufacturers have yet to create lingerie that include pieces that move along straps using channeled seams to allow for the movement. In the absence of mechanical assemblies, lingerie is more comfortable and discrete under clothing. Such examples of use include, but are not limited to, a sliding crotch in a panty, bodysuit, or a bra where the cups slide to either cover or uncover the breast.

U.S. Pat. No. 5,499,404, to Marchiorello discloses an article of men's underwear having a front aperture bounded by two edges and having a front portion of a waistband with two strips for independently supporting the edges, at least one of the edges is slidable along its respective strip between a position in which the two edges are at least partly superposed and a position in which they are spaced apart.

U.S. Pat. No. 6,557,183 B1, to Truong discloses an underwear construction having a trunk panel, an inner panel with an open edge for providing access through the inner panel, an outer panel having openings along opposed side edges, the outer panel overlying the inner panel, wherein the trunk panel, inner panel, and outer panel are joined to provide a wearer of said underwear selective unencumbered access to the penis through either of the openings in said outer panel and through the open edges of said inner panel.

U.S. Pat. No. 6,240,563 B1, to Niedermeyer discloses an article of apparel comprising a first segment and a second segment of substantially similar shape, each having at least two side margins parallel to a central line and at least one margin at an angle to the central line. One segment has flap extensions along selected margins for folded securement to the other segment thus forming a garment with folded external seams. In a three segment embodiment, one panel is constructed from two similarly shaped half width segments that are overlapped to form an openable panel with resealable closure means. In another two panel embodiment, both half width panels are partially overlapped to form a central 2-ply area, portions of which are bonded together in a region that becomes the rear panel. After rear portions of the bonded segments are folded in half over and around a transverse fold line, front and rear panels are connected with side flaps. The overlapped area in the front panel remains unbonded to form an opening which is secured by resealable tapes or equivalent means.

U.S. Pat. No. 5,864,890, to Niedermeyer discloses an undergarment including waist and leg apertures and openable front panel with a closure. The undergarment including similarly shaped overlapped superposed half width segments bonded to each other in a pre-selected area to form front and rear panels having a crotch area. The garment also includes non-bonded overlapped portions forming two halves of an openable front panel connected at the top of the opening by a tape. The rear panel overlapped segments are bonded together. Reusable tapes are also used to attach the segments halves together in the front panel. The rear panel includes flap extensions protruding from each side margin and the extension attach to the side margins of the front portion. The garment is folded in the crotch region.

U.S. Pat. No. 6,513,209 B1, to Portzline discloses a fastening system for an article of apparel, advantageously a bra, including first and second coupling members attached to ends of a hemband. The coupling members are movable between an engaged or locked state when the bra is worn and a disengaged state to remove the bra. The coupling members are integrally molded and each includes a stitch plate and a plurality of locking members. The locking members on one coupling member are hooks while the other are loops. The coupling members have a flex groove formed therein between their locking members to make the coupling members more flexible. The flex grooves may optimally extend across the stitch plates to further enhance flexibility. The ends of the hooks are angularly displaced from their stitch plates. This raises the interlocking locking portions away from the back of the wearer to increase comfort. Additionally, the hooks include opposed angled guide surfaces. The opposed angled guide surfaces each have a parallel guide surface on an adjacent hook.

U.S. Pat. No. 6,056,626, to Fildan discloses an extremely flat slide for brassiere straps has a cross bar offset to one side so that the strap loop around it lies wholly within the thickness of the slide. The strap section which passes through the ring affixed to the brassiere cup is attached to the slide, e.g. at the sewing flange or via a weld at a welding flange.

U.S. Pat. No. 6,499,201 B2, to Fildan discloses a garment fastener, especially for lingerie and swimsuits has elongated loops on each fastener half from the outer bar of which an attachment flange extends. The attachment flange is a sewing flange and/or welding flange and the fabric strip passing through the slot of the loop is stitched and/or welded to the attachment flange.

U.S. Pat. No. 5,590,443, to Fildan, discloses a nonslip slide or buckle has elongated teeth projecting along edges of openings defined between the outer limbs and the central limb and through which straps are looped for lingerie or corsetry, thereby preventing slippage of the buckle relative to the straps or vice versa without allowing snagging of outer garment fabrics.

U.S. Pat. No. 5,624,296, to Weber discloses the handling of items of clothing having an arrangement for connecting and separating two coupling elements, a pocket or bridge which serves to receive the tip of the thumb or of a finger of the wearer is assigned to at least in each case one coupling element. With the aid of the thumb tip inserted into the pocket, the coupling elements can be easily separated and also connected again.

U.S. Pat. No. 6,302,761, to Wrenn discloses an improved brassiere is disclosed that provides a high level of comfort, wide ranging adjustability and improved breast support while minimizing fatigue and improving the posture of the user using a support system which includes strategically attached shoulder straps which cross in the back at a unique swivel. Each shoulder strap is detachably attached at one to the top of a breast cup, and attached at the opposite end to the side of the opposite cup. An adjustable coupling is provided between the cups. The adjustable swivel includes a pair of pivotally attached short flat hollow sleeves for slidably receiving the shoulder straps. Because the shoulder straps are slidably disposed in the sleeves of the swivel, it will move up or down slightly as the wearer moves, stretches, bends over, etc. In the preferred embodiment, no bonding, wire or elastic is used. Instead, cotton piping is used around the lower breast cups for support, wide cotton belting is used for the straps, and the entire framework of the brassiere is constructed of a sturdy cotton fabric that is interlined with fusible fleece and lined with cotton flannel for comfort.

U.S. Pat. No. 6,253,424, to Rainville discloses a closure for securement to an article of apparel and for use by a person having handicapped hands is described. The closure comprises a first fastener support member which has one or more fastener elements secured thereto. A second fastener support member is provided and has one or more fastener elements for interconnection with the fasteners of the first support member. The first and second fastener support members are adapted for securement to articles of apparel. The fasteners are removably interconnectable together with the support members overlapping. A first fabric loop is provided in a front face of one of the fastener support members and a second fabric loop is secured to a lower portion of the other fastener support member, and may depend therefrom or be concealed therebehind. The loops are of predetermined size and are disposed for engagement by a handicapped person for attaching and detaching the fasteners with one another with the support members overlapped with one another.

U.S. Pat. No. 5,032,104, to Rainville discloses a brassiere for handicapped people provides detachable and adjustable fabric fastening pads to temporarily hold the two halves together, and finger loops for those who cannot grip. The brassiere has a front opening with an overlapping portion joined to one brassiere cup which overlaps an underlapping portion joined to the other cup. Detachable and adjustable fabric fastening pads or the like are provided on the underside of the overlapping portion to engage with one or more corresponding support pads on the top surface of the underlapping portion. Fabric loops for fingers are provided attached to the overlapping and underlapping portions to avoid a person having to grip the edges of the two portions.

U.S. Pat. No. 4,917,651, to Rainville discloses a brassiere for handicapped people provides detachable and adjustable fabric fastening pads to temporarily hold the two halves together, and finger loops for those two who cannot grip. The brassiere has a front opening with an overlapping portion joined to one brassiere cup which overlaps an underlapping portion joined to the other cup. Detachable and adjustable fabric fastening pads are provided on the underside of the overlapping portion to engage with support pads on the top surface of the underlapping portion. Fabric loops for fingers are provided attached to the overlapping and underlapping portions to avoid a person having to grip the edges of the two portions.

U.S. Pat. No. 6,282,719 B1, to Vera, discloses a combination nightgown and bra for women after pregnancy that enables the wearer to conveniently and comfortably nurse her baby by unsecuring a flap on either cup and resecuring upon completion of nursing, without the necessity of dealing with various articles of clothing and putting them on and taking them off. The gown can also be worn during pregnancy for support.

U.S. Pat. No. 6,839,908 B2, to Schneider discloses a women's apparel having a unique and improved maternity and/or nursing breast support and enables the wearer to comfortably unsecure and secure a flap on a bra cup upon completion of nursing. The main inventive feature is a dynamic non-continuous or hanging bra support system made with a plurality of fabric members triangular in shape to allow a sizeable opening in each brassiere cup. The fabric member in each cup are joined at the upper end and create vertically oriented openings for maximum breast exposure that allows access to the breast and at same time leave room for expansion of the breasts. The upper edges of the triangular cups are diagonally oriented, and the cups are attached only partially, at the lower portion to narrow regions of a stretchable band and/or laterally, to the slide, thus providing flexibility, support and comfort for the wearer.

U.S. Pat. No. 6,854,132, to Polzin discloses a nursing garment, the present invention includes an outer garment and an inner garment. The outer garment can be any suitable garment which has a tubular body for covering the upper body region. The inner garment is disposed within the tubular body of the outer garment and attached to the outer garment. The inner garment can be any camisole-type garment which includes two chest panels that overlap with one another in crisscross fashion. The chest panels receive and support the wearer's breasts. A nursing mother may raise the outer garment over her chest and pull either chest panel below her breast to make the breast accessible to her baby.

U.S. Pat. No. 5,697,830, to White discloses a nursing brassiere that provides added support and yet can be easily manipulated to provide nursing access. The brassiere has overlapping frontal portions each with a cup-like configuration for covering the wearer's breasts. The frontal portions are attached to a lower elastic or elastic type cut and sewn portion below the breasts which includes a wrap-around band. Along a lower outer border of each cup-like frontal portion is a relatively short arcuate wire member that provides breast support under normal wear conditions. When nursing takes place, a frontal portion is easily pulled aside to displace the supporting wire and expose the breast for the necessary nursing access.

U.S. Pat. No. 4,280,228, to Sulzmann discloses a nursing blouse which allows access to the infant to be nursed through openings which are concealed by overlapping portions of the blouse at the sides thereof and which are stitched at new and novel locations of the blouse. The new and novel strips or folds of the blouse at the openings and the stitchings of this invention provides a nursing blouse which does not require connecting means to keep the openings closed when not in use even when the wearer applies stress to the chest part of the blouse due to physical activity and does not require any camouflage design.

U.S. Pat. No. 4,911,677, to White discloses a nursing brassiere is disclosed having a frontal sectional comprised of partially overlapping frontal portions each adapted to cover one side of the a wearer's chest area. The frontal portions are connected to a lower band that fits around the wearer and has inner and outer overlapping members which are normally held together but are separable. Each frontal portion is attached to one overlapping band member so that it can be separately displaced by the wearer to facilitate nursing.

U.S. patent application Ser. No. 20020062541, to Fildan discloses a link having snap-fitted parts with selected stones having different appearances to render the link highly versatile. The garment link, for brassieres, lingerie and the like, can use a perfume stone with laser-perforated capillaries communicating with a cavity from which scent may be released and which serves to draw a perfume liquid into the cavity.

U.S. patent application Ser. No. 20040226147, to Feldman discloses a slide and slide assembly for linergie and brassieres have the end of a strap bonded to the central bar of the slide at the same side as that at which the strap is threaded around the central bar of the slide to limit slippage of the slide relative to the strap.

U.S. patent application Ser. No. 20020155786, to Querquant discloses lingerie articles comprising at least a molded region to create a retaining and supporting volume of at least a curved part of the human body, made from a tubular knitted fabric formed with a first extensible and thermoformable material, provided with a ribbing which forms one of the edges of said article elastically enclosing the body, the final shape of the article being produced by cuts performed in the tubular knitted fabric from the free end opposite the ribbing. The invention is characterized in that each molded volume region is lined by internal bonding of at least a lining consisting of a second extensible heat-activated material whereof one surface is coated with an adhesive material capable of being heat-activated, the materials of the knitted fabric and of the lining having either thermoformed or elastic percent elongation, and the adhesive having an activating temperature such that they enable deformation included by hot molding of the molded regions to provide them with volume without affecting the heat-bonded linkage, said first and second materials preserving their supporting and retaining capacity after molding.

U.S. patent application Ser. No. 2002009572, to Fildan discloses a garment fastener, especially for lingerie and swimsuits has elongated loops on each fastener half from the outer bar of which an attachment flange extends. The attachment flange is a sewing flange and/or welding flange and the fabric strip passing through the slot of the loop is attached and/or welded to the attachment flange.

U.S. patent application Ser. No. 20040006878, to Grove discloses a wearable garment pattern template configured to be worn by a person includes a plurality of detachably coupled sections each having a plurality of flexible segments which are coupled at pivot points. The adjustable segments include at least two strips which are longitudinally slidable relative to each other such that the segments are adjustable in length and can also be fixed in length. The segments define a framework of either triangles with sides of a particular length (as adjusted on the wearer), or quadrilaterals having sides of a set length (as adjusted on the wearer) and at least one fixed angle between two of the sides. In either instance, after adjustment, each triangle or quadrilateral can be only in one configuration, and is not subject to distortion due to rotation about pivot points. The garment pattern template can be used as a template to cut fabric for a garment.

U.S. patent application Ser. No. 20030051287, to Hatton discloses an examination garment to be worn by a patient during a physical examination includes an upper garment and a lower garment. The upper garment includes a first front panel, a second front panel, a rear panel having an opening for examination of a patient's spine, and fasteners for removably connecting various points of the frontal and rear panels. The lower garment includes a front panel with a movable front center panel and leg members, a rear panel with a movable rear center panel, leg fasteners for removably connecting the leg members, and panel fasteners for removably connecting rear panel and rear center panel U.S. Design Pat. No. D353,559, to Fildan discloses an ornamental design for a combined strap and slide assembly for lingerie, as shown and described.

U.S. Design Pat. No. D413,549, to Fildan discloses an ornamental design for a press-button terminus for a brassiere underwire, as shown and described.

U.S. Design Pat. No. D412,462, to Fildan discloses an ornamental design for a maternity brassiere closure hook, as shown and described.

U.S. Design Pat. No. D410,411, to Fildan discloses an ornamental design for a maternity brassiere front closure, as shown and described.

U.S. Design Pat. No. D473,363 S, to Loussier discloses an ornamental design for a breast feeding clothes, as shown and described.

While these units may be suitable for the particular purpose employed, or for general use, they would not be as suitable for the purposes of the present invention as disclosed hereafter.

SUMMARY OF THE INVENTION

It is an object of the invention to produce apparel which facilitates easy access to body parts while still being fashionable and sexy. Accordingly, the present invention is a one piece undergarment, having a pair of straps and at least one moveable panel for sliding along said straps to easily access body parts while still being fashionable and sexy.

It is another object of the invention to provide a means for easily reconfiguring apparel. Accordingly, the one piece undergarment of the present invention includes at least one moveable panel which is secured by a channel along the pair of straps, corset boning, strings, chains, or other sewing notion varieties thereby providing for wide ranging adjustability by allowing a wearer to selectively modify a piece of apparel by sliding one or more moveable panels.

It is another object of the invention to provide apparel with a greater level of comfort and support. Accordingly, the moveable panels of the present invention substitute as a common element of the lingerie, such as a tube portion of a bodysuit, thereby providing a greater level of comfort and support.

It is another object of the invention to provide a convenient means for enhancing sexual foreplay. Accordingly, the one piece undergarment allows for apparel, preferably lingerie, to remain on the wearer, while utilizing the moveable panel to cover and uncover various body parts.

The invention is a one piece undergarment for wear on a torso and legs of a body, having at least two straps extending substantially parallel to one another. A plurality of moveable panels extending along the two straps and configured as a plurality of tube portions one above another, each panel having two parallel edges extending horizontally around the body. The moveable panel is secured by at least two moveable seams, each seam creating a channel by encasing the strap from one parallel edge to the other parallel edge of the moveable panel, thereby allowing each moveable panel to slide upwardly and downwardly along the body.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 4:
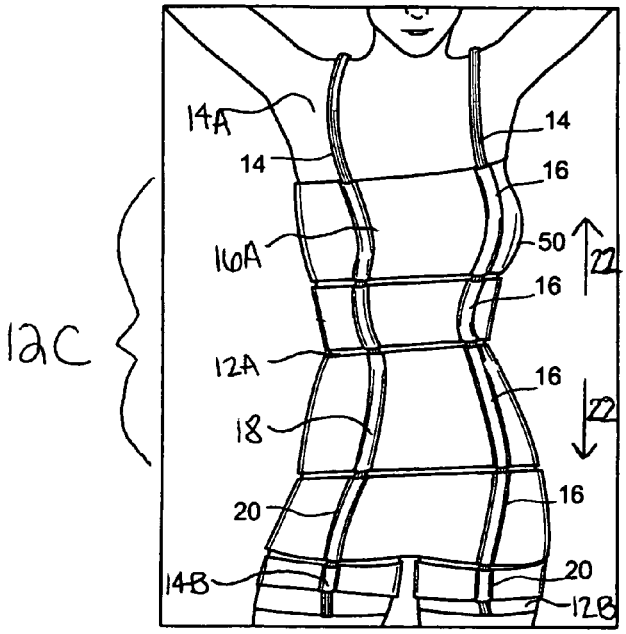
FIG. 4 is a diagrammatic perspective view of the present invention having at least two straps and a plurality of moveable panels, each panel having two parallel edges, and two elongated seams, each seam creating a channel by encasing the strap from one parallel edge to the other parallel edge.

FIG. 4 illustrates a one piece undergarment bodysuit 10 incorporated within apparel for wear on a torso 12A and legs 12B of a body 12C. The one piece undergarment bodysuit 10 facilitates access to body parts, while providing wide ranging adjustability, and greater level of comfort and support while being fashionable and sexy. In the preferred embodiments illustrated herein the apparel is lingerie 11, such as bodysuits 50 shown in FIGS. 4 and 5.

In its broadest context, the one piece undergarment bodysuit 10 includes at least two straps 14, preferably a pair of straps 14 that extend substantially parallel to one another and each have a first end 14A and second end 14B. Preferably, the straps 14 are made from an elastic material for easily stretching to accommodate different body types and sizes. A plurality of moveable panels 16 extending along the two straps 14. Additionally, other possible embodiments of the present invention may use straps 14 made of materials such as cord, pearls, wire, bras, or corset boning for the moveable panel 16 to slide along.

The moveable panel 16 substitutes as a common element of the lingerie 11, such as a tube portion of the bodysuit, for providing a greater level comfort and support. The one piece undergarment bodysuit 10 is a convenient means for enhancing sexual foreplay because said bodysuit 10 allows for apparel, preferably lingerie, to remain on the wearer, while utilizing the moveable panel 16 to cover and uncover various body parts.

The plurality of moveable panels 16 are configured as a plurality of tube portions one above another for selectively enclosing the torso 12A and legs 12B of the body 12C. Each moveable panel 16 has two parallel edges 16A extending horizontally around the body 12C. At least two elongated seams 20, each seam 20 creating a channel 18 by encasing the strap 12 from one parallel edge 16A to the other parallel edge 16A, thereby allowing each moveable panel 16 to slide upwardly and downwardly along the body 12C. Technology in lingerie production continues to evolve and the seam utilized herein may be replaced via glue, heat-setting, bonding or other like methods. Alternatively, seaming may include simple loops, fabric, metal or other like material.

Figure 5:
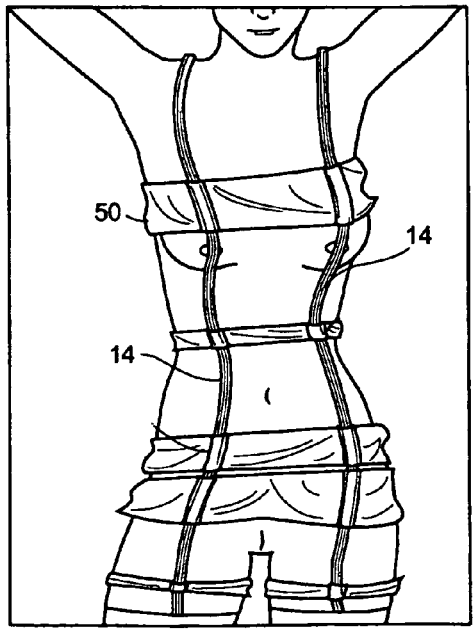
FIG. 5 is a diagrammatic perspective view of the present invention incorporated within a bodysuit, wherein the wearer can slide one or move of the moveable panels upwardly or downwardly to cover or uncover body parts.

In this embodiment of the present invention as illustrated in FIGS. 4 and 5 the second end 14B of the straps 14 can include hooks for securing thigh highs thereto.

The channels 18 allow sliding movement 22 of the moveable panel 16 in the forward and backward or upward and downward direction. Here, the moveable panel 16 can slide from the first end 14A of the straps 14 to the second end 14B of the straps 14, as well as scrunch-up in a gathered type fashion therebetween. Preferably, the moveable panel 16 is made from a soft and flexible fabric for comfortable fitting the wearer and easily sliding along the straps 14.

In the preferred embodiment shown in FIGS. 4 and 5 the straps 14 extend throughout the bodysuit 50 within the channels 18 of each moveable panel 16. A wearer can slide one or move of the moveable panels 16 upwardly or downwardly as shown in FIG. 5 to cover or uncover body parts. This provides for wide ranging adjustability by allowing a wearer to selectively modify the bodysuit 50 by sliding one or more moveable panels 16.

Alternate embodiments of the present invention utilizing the garment sliding mechanism 10 and moveable panel 16 may include draperies, shown curtains, and double sliding panels. Additionally, other possible embodiments of the present invention may use straps 14 made of materials such as cord, pearls, wires, bars, or corset boning for the parts of said embodiments to slide along.

In conclusion, herein is presented garment sliding mechanism for apparel. The invention is illustrated by example in the drawing figures, and throughout the written description. It should be understood that numerous variations are possible, while adhering to the inventive concept. Such variations are contemplated as being a part of the present invention.

What is claimed is:

1. A one piece undergarment bodysuit, for wear on a torso and legs of a body, comprising:

at least two straps extending substantially parallel to one another and each having a first end and second end;

a plurality of moveable panels extending along the two straps, substantially configured as a plurality of tube portions one above another for selectively enclosing the torso and legs of the body, each panel having two parallel edges extending horizontally around the body; and at least two elongated seams, each seam creating a channel by encasing the strap from one parallel edge to the other parallel edge of the moveable panel, thereby allowing each moveable panel to slide upwardly and downwardly along the body.

2. The garment sliding mechanism of claim 1 wherein the straps are elastic for easily stretching to accommodate different body types and sizes.

3. A method of adjusting apparel such that different body portions are covered and uncovered using a one piece undergarment for wear on a torso and legs of a body, having at least two straps extending substantially parallel to one another and each having a first end and second end, a plurality of moveable panels extending between the two straps, substantially configured as tube portions and selectively enclosing the torso and legs of the body, each panel having two parallel edges extending horizontally around the body, and at least two elongated seams, each seam creating a channel by encasing the strap from one parallel edge to the other parallel edge of the moveable panel, the steps comprising:

sliding one or more of the moveable panels upwardly or downwardly along the straps, covering or uncovering portions of the torso and legs of the body.

* * * * *